US010680354B1

(12) United States Patent
Antaya

(10) Patent No.: US 10,680,354 B1
(45) Date of Patent: Jun. 9, 2020

(54) ELECTRICALLY CONDUCTIVE CONNECTOR

(71) Applicant: Antaya Technologies Corporation, Warwick, RI (US)

(72) Inventor: Stephen C. Antaya, West Kingston, RI (US)

(73) Assignee: Antaya Technologies Corporation, Warwick, RI (US)

( * ) Notice: Subject to any disclaimer, the term of this patent is extended or adjusted under 35 U.S.C. 154(b) by 0 days.

(21) Appl. No.: 16/353,141

(22) Filed: Mar. 14, 2019

(51) Int. Cl.

| | |
|---|---|
| ***H01R 4/02*** | (2006.01) |
| ***H01R 4/62*** | (2006.01) |
| ***H01R 43/02*** | (2006.01) |
| ***H01R 43/20*** | (2006.01) |

(52) U.S. Cl.
CPC ..... *H01R 4/625* (2013.01); *H01R 4/02* (2013.01); *H01R 43/02* (2013.01); *H01R 43/20* (2013.01)

(58) Field of Classification Search
CPC ..... H01R 4/02; H05K 1/02
See application file for complete search history.

(56) References Cited

U.S. PATENT DOCUMENTS

| | | | | |
|---|---|---|---|---|
| 4,460,450 | A * | 7/1984 | Koziol | C25B 9/04 204/290.03 |
| 5,286,925 | A * | 2/1994 | Cabaraux | C25C 7/02 174/126.2 |
| 9,837,727 | B2 * | 12/2017 | Schmalbuch | H01R 12/53 |
| 2007/0105412 | A1 * | 5/2007 | Hoepfner | C22C 1/002 439/83 |
| 2009/0277671 | A1 * | 11/2009 | Hahn | B32B 17/10036 174/257 |
| 2011/0297450 | A1 * | 12/2011 | Can | C23C 28/347 175/426 |
| 2012/0199068 | A1 * | 8/2012 | Hillabrand | C01B 33/035 118/723 E |
| 2014/0182932 | A1 * | 7/2014 | Cholewa | H05B 3/84 174/84 R |
| 2014/0227551 | A1 * | 8/2014 | Rateiczak | H05B 3/84 428/615 |
| 2017/0033242 | A1 * | 2/2017 | Nam | H01L 31/022441 |
| 2017/0033481 | A1 | 2/2017 | Schmalbuch et al. | |
| 2018/0330845 | A1 * | 11/2018 | Reul | H01B 7/40 |

* cited by examiner

*Primary Examiner* — Chau N Nguyen
(74) *Attorney, Agent, or Firm* — Robert J. Myers

(57) ABSTRACT

An illustrative example method of making an electrically conductive connector comprising a first material and a second material, includes situating a layer comprising the second material at least partially within at least one layer comprising the first material and bonding the layers together. The first material has a first coefficient of thermal expansion and the second material has a second coefficient of thermal expansion that is different than the first coefficient of thermal expansion.

2 Claims, 3 Drawing Sheets

ELECTRICALLY CONDUCTIVE CONNECTOR

BACKGROUND

There are various situations in which it is desirable to secure metal to glass. For example, rear windows on vehicles often include a heater to remove or reduce ice or condensation. One challenge associated with such devices is making electrically conductive connections between the metal and a power source or controller. Establishing a soldered connection, for example, requires heat. The differences between the thermal coefficients of expansion of glass and a conductive metal, such as copper, introduces a high likelihood that the glass will break or otherwise be compromised during the soldering process. Additionally, the extreme temperatures that a vehicle may be exposed to and the different thermal coefficients of expansion tend to introduce stress on the glass.

SUMMARY

An illustrative example method of making an electrically conductive connector comprising a first material and a second material, includes situating a layer comprising the second material at least partially within a layer comprising the first material and bonding the layers together. The first material has a first coefficient of thermal expansion and the second material has a second coefficient of thermal expansion that is different than the first coefficient of thermal expansion.

An example embodiment having one or more features of the method of the previous paragraph includes establishing a channel in the least one layer comprising the first material, situating the layer comprising the second material at least partially in the channel, and subsequently bonding the layers together to secure the second material in the channel.

An example embodiment having one or more features of the method of any of the previous paragraphs includes covering at least some of the layer comprising the second material with another layer comprising the first material and completely surrounding the second material with the first material.

In an example embodiment having one or more features of the method of any of the previous paragraphs, the first material comprises copper and the second material comprises a nickel alloy.

An example embodiment having one or more features of the method of any of the previous paragraphs includes applying a solder to at least a portion of the conductive connector after the bonding, wherein the solder comprises at least 40% by weight Indium.

An example embodiment having one or more features of the method of any of the previous paragraphs includes applying the solder to an area on an exterior of the conductive connector along a portion of the exterior that is at least coextensive with an area of the layer comprising the second material.

In an example embodiment having one or more features of the method of any of the previous paragraphs, the bonding comprises heating the at least one layer comprising the first material and the layer comprising the second material, and applying pressure to the heated layers.

In an example embodiment having one or more features of the method of any of the previous paragraphs, applying the pressure comprises rolling the heated layers.

In an example embodiment having one or more features of the method of any of the previous paragraphs, a first layer of the at least one layer comprising the first material has a first thickness and a first width, a second layer of the at least one layer comprising the first material has a second thickness and a second width, the layer comprising the second material has a third thickness and a third width, the first thickness is greater than the second thickness, the second width is less than the first width, the third thickness is less than the first thickness, and the third thickness is greater than the second thickness.

In an example embodiment having one or more features of the method of any of the previous paragraphs, a first difference between the first coefficient of thermal expansion and a coefficient of thermal expansion of glass is greater than a second difference between the second coefficient of thermal expansion and the coefficient of thermal expansion of glass.

An illustrative example electrically conductive connector includes at least one layer comprising a first material that has a first coefficient of thermal expansion. A layer comprising a second material having a second coefficient of thermal expansion is situated at least partially within the at least one layer comprising the first material. The layers are bonded together.

An example embodiment having one or more features of the conductive connector of the previous paragraph includes a layer of solder on at least a portion of an exterior of the conductive connector.

In an example embodiment having one or more features of the conductive connector of any of the previous paragraphs, the solder comprises a lead-free alloy.

In an example embodiment having one or more features of the conductive connector of any of the previous paragraphs, the solder comprises at least 40% by weight Indium.

In an example embodiment having one or more features of the conductive connector of any of the previous paragraphs, a first difference between the first coefficient of thermal expansion and a coefficient of thermal expansion of glass is greater than a second difference between the second coefficient of thermal expansion and the coefficient of thermal expansion of glass.

In an example embodiment having one or more features of the conductive connector of any of the previous paragraphs, the first material comprises copper and the second material comprises a nickel alloy.

In an example embodiment having one or more features of the conductive connector of any of the previous paragraphs, the at least one layer comprising the first material comprises a channel and the layer comprising the second material is situated at least partially within the channel.

In an example embodiment having one or more features of the conductive connector of any of the previous paragraphs, the channel has a depth, a first layer of the at least one layer comprising the first material has a first thickness, a second layer of the at least one layer comprising the first material has a second thickness, the layer comprising the second material has a third thickness, and the depth is approximately equal to a sum of the second thickness and the third thickness.

In an example embodiment having one or more features of the conductive connector of any of the previous paragraphs, the first thickness is greater than the third thickness and the third thickness is greater than the second thickness.

In an example embodiment having one or more features of the conductive connector of any of the previous paragraphs, a second layer comprising the first material is received against a side of the layer comprising the second material facing away from the channel and the second material is encased in the first material Various features and advantages of at least one disclosed example embodiment will become apparent to those skilled in the art from the following detailed description. The drawings that accompany the detailed description can be briefly described as follows.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
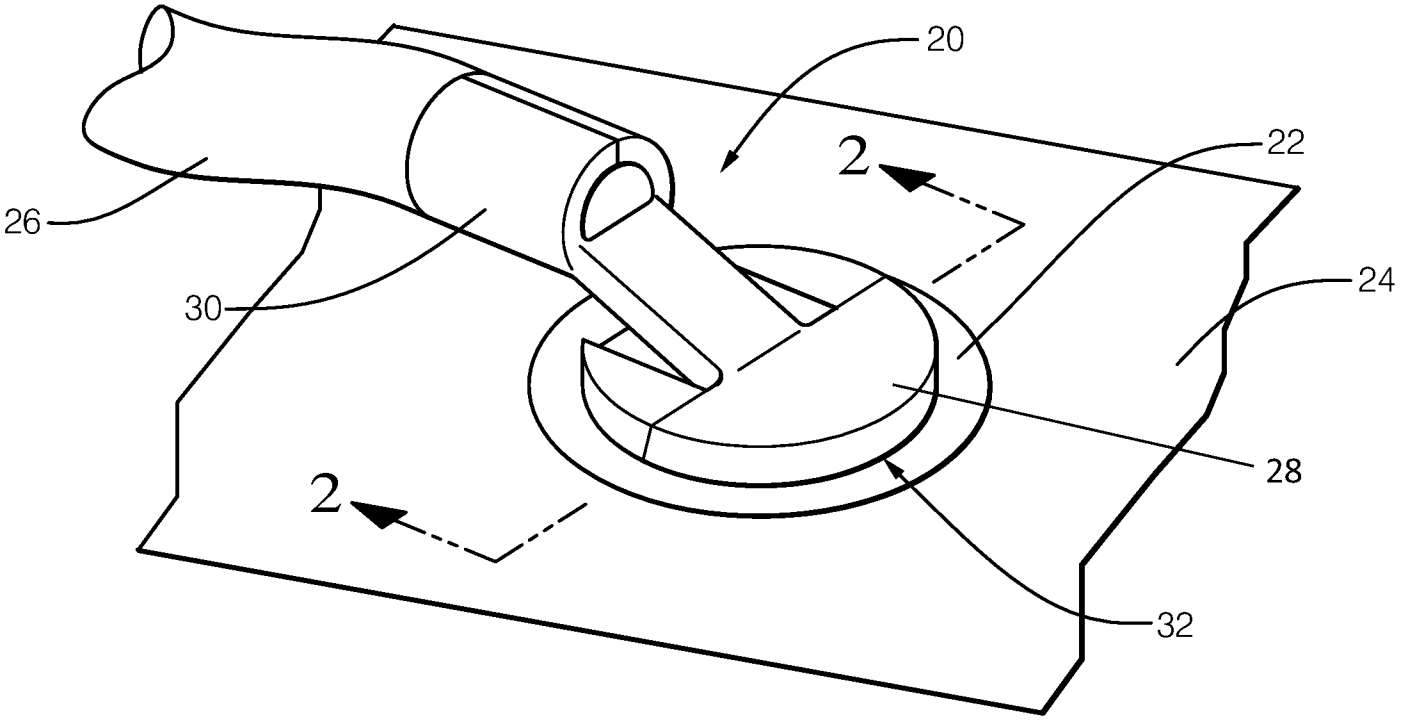
FIG. 1 diagrammatically illustrates an example of an electrically conductive connector designed according to an embodiment of this invention.

FIG. 1 shows an example configuration of an electrically conductive connector 20 that establishes a connection between an electrical component 22 supported on a glass substrate 24 and a conductor 26. For example, the electrical component 22 may be a bus bar used for powering a heater that is supported on a vehicle window. In such examples, the glass substrate 24 would be a window of the vehicle. The connector 20 includes a base 28 near one end and a coupling portion 30 near an opposite end. In this example, the base 28 is soldered to the electrical component 22 at an interface 32 between them. The coupling portion 30 is crimped onto the conductor 26.

Figure 2:
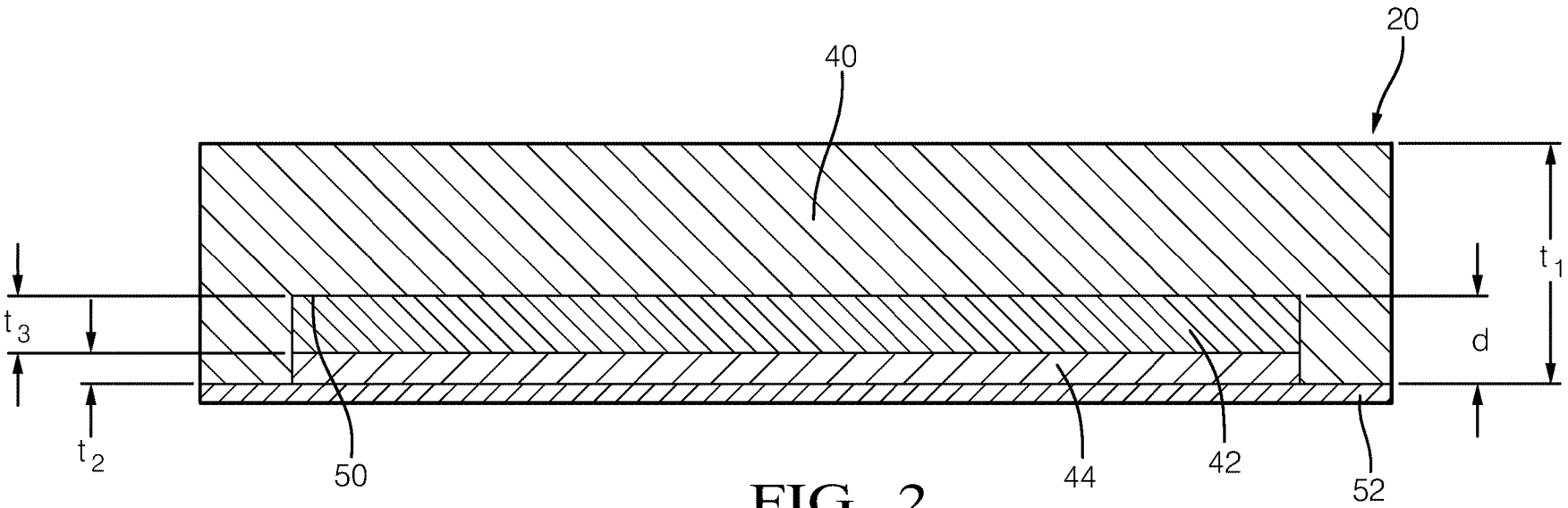
FIG. 2 is a cross section diagram schematically illustrating an arrangement of layers taken along the lines 2-2 in FIG. 1.

The connector 20 comprises first and second materials. FIG. 2 is a cross-sectional illustration of an arrangement of multiple layers of the materials in the embodiment of FIG. 1. At least one layer 40 comprises the first material, which is electrically conductive and selected for making a conductive connection with the electrical component 22 and the conductor 26. In the illustrated example, the first material comprises copper. Another layer 42 comprises the second material, which is a nickel-iron alloy in this example. Another layer 44 comprises the first material. The layer 42 comprising the second material is situated between the layers 40 and 44. The layers 40, 42, and 44 are bonded together in this embodiment.

The second material may comprise at least one of the commercially available materials sold under the trade names INVAR and KOVAR. Some embodiments include stainless steel as the second material or another metal. The first material, such as copper, provides excellent electrical conductivity and has a first coefficient of thermal expansion. The second material has a second, different coefficient of thermal expansion. The second material is selected to provide a coefficient of thermal expansion that more closely resembles that of glass. In other words, a first difference between the first coefficient of thermal expansion of the first material and the coefficient of thermal expansion of glass is greater than a second difference between the second coefficient of thermal expansion of the second material and the coefficient of thermal expansion of glass.

Including a layer of the second material effectively alters the overall coefficient of thermal expansion of the connector 20 for reducing stress on the glass 24 and allowing for a reliable electrical connection with the component 22 supported on the glass 24. Including the second material within at least the base 28 of the connector 20 reduces stress on the glass otherwise associated with high temperatures, such as during soldering the base 28 to the electrical component 22 or when the vehicle including the glass is exposed to high temperatures.

In an example embodiment, including the second material within at least the base 28 of the connector 20 and using INVAR as the second material provides a coefficient of thermal expansion of approximately 10.3 PPM/° C., which more closely resembles the coefficient of thermal expansion of soda lime glass, which is approximately 8.9 PPM/° C. By comparison, copper alone (i.e., without the second material insert) has a coefficient of thermal expansion of approximately 16.7 PPM/° C. In this embodiment instead of having the coefficient of thermal expansion of the soldered portion of the connector 20 be about twice of that of the glass 24, there is a difference on the order of 25%, which significantly reduces the likelihood that the glass 24 will crack during soldering.

As shown in FIG. 2, the layer 40 includes a pocket or channel 50. The layer 42 comprising the second material is situated at least partially within the channel 50. In this example, the layer 42 has a width that corresponds to a width of the channel 50. The layer 44 comprising the first material is received over the layer 42 and within the channel 50. A layer of solder 52 covers the layer 44 and portions of the layer 40 that are exposed on the side of the base 28 that will be situated against the electrical component 22 when the base 28 is soldered in place.

The solder layer 52 covers enough of the base 28 in this example to facilitate securing the base 28 to the electrical component 22. The solder layer 52 in this embodiment has an area that is at least as large as an area of the layer 42 comprising the second material. In other words, the solder layer 52 is coextensive with the layer 42 and at least as long and wide as the channel 50. In the illustrated example, the solder layer 42 covers an entire side of the base 28.

One feature of some embodiments is that the solder layer 52 comprises an alloy having a sufficient amount of Indium to reduce or eliminate cracks in the glass 24 that would otherwise result from the process of soldering the base 28 to the electrical component 22. For example, the solder layer 52 in some embodiments includes at least 45% by weight Indium. In some embodiments 40% by weight Indium is sufficient to adequately protect against cracking or other damage to the glass substrate supporting the electrical component to which the connector 20 is soldered. This invention includes the discovery that increased amounts of Indium in a solder layer reduces the occurrence of cracks in a glass substrate.

Some embodiments include a treated glass material, such as tempered glass, or a polycarbonate instead of glass and the solder layer 52 includes a lower amount of Indium than the percentages mentioned above. Some embodiments may include a solder that does not include Indium.

As shown in FIG. 2, the layer 40 has a first thickness $t_1$, the layer 44 has a second thickness $t_2$, and the layer 42 has a third thickness $t_3$. In this example, the first thickness $t_1$ is greater than the third thickness $t_3$. The second thickness $t_2$ is smaller than the third thickness $t_3$. The channel 50, in this example, has a depth d that is approximately equal to the sum of the second thickness $t_2$ and the third thickness $t_3$.

In the example of FIG. 2, the layer 42 comprising the second material is completely encased in layers of the first material such that the layer 42 may be considered an insert within a portion of the connector 20 that comprises the first material. Including an insert comprising a nickel-iron alloy within an electrically conductive connector comprising copper allows for achieving a reliable soldered connection while reducing the likelihood of inducing stress in a glass substrate.

Figure 3:
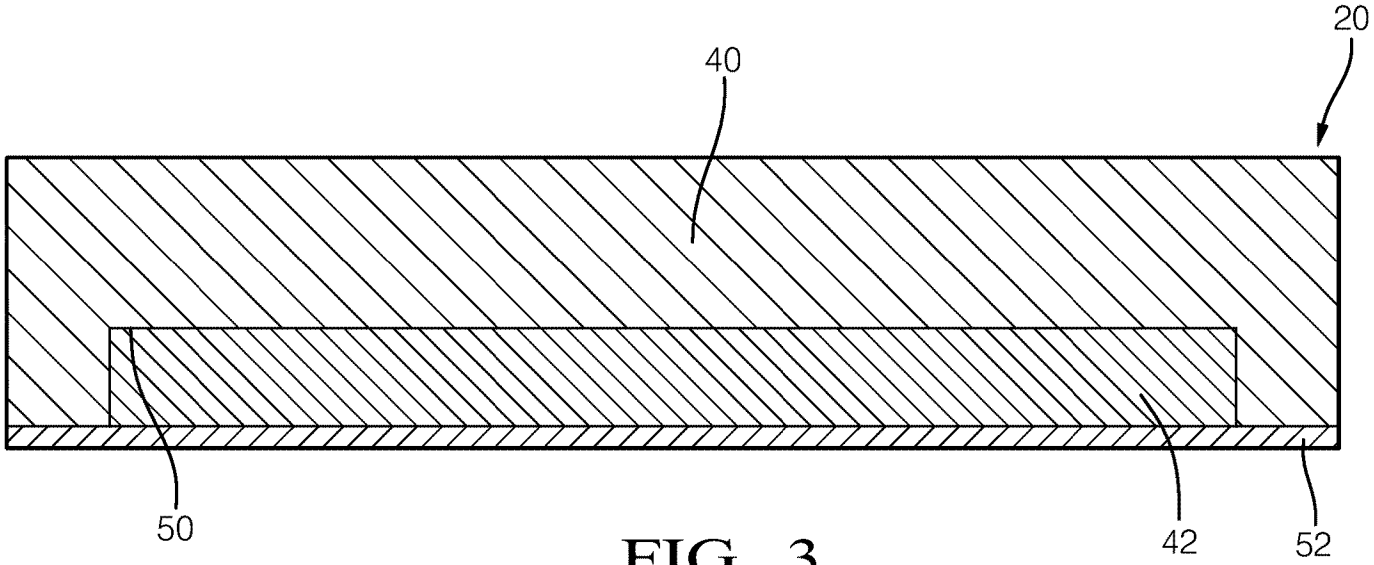
FIG. 3 is a cross section diagram schematically illustrating an arrangement of layers of another example electrically conductive connector designed according to an embodiment of this invention.

FIG. 3 is an illustration similar to FIG. 2 but showing another embodiment. In this example, the layer 42 comprising the second material is exposed rather than being covered by another layer comprising the first material, such as the layer 44 included in the embodiment of FIG. 2. The layer 40 is the only layer comprising the first material in FIG. 3. Although the layer 40 is shown as a single layer it may comprise multiple layers or stacked pieces of the same material that are bonded together when the layers 40 and 42 are bonded together. The embodiment of FIG. 3 also includes a solder layer 52 like that discussed above.

Figure 4:
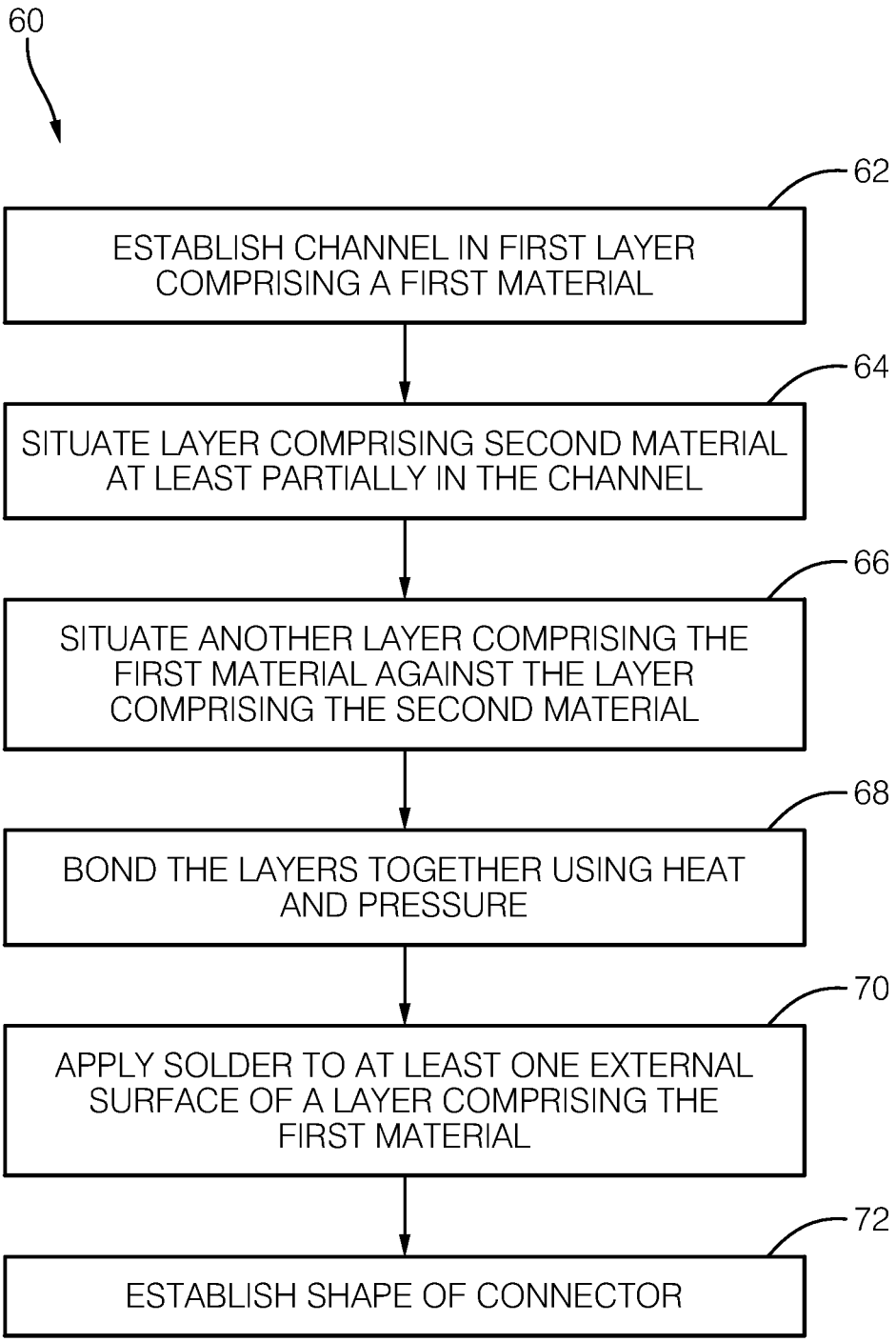
FIG. 4 is a flowchart diagram summarizing a method of making an electrically conductive connector designed according to an embodiment of this invention.

FIG. 4 includes a flowchart diagram 60 that summarizes an example method of making an electrically conductive connector 20. In this example, the channel 50 is established in a first layer 40 comprising the first material at 62. The layer 42 comprising the second material is situated at least partially in the channel 50 at 64. Another layer 44 comprising the first material is situated against a layer 42 at 66.

At 68, the layers 40, 42, and 44 are bonded together using heat and pressure. Some examples include a known pressure/temperature (PT) bonding process to achieve the bond established at 68. Some embodiments utilize a cladding method or a rolling process for securing the layers 40-44 together.

At 70, a layer of solder 52 is applied to at least one external surface of the layers that have been bonded together. At 72, the shape of the connector is established, for example, by stamping the material resulting from bonding the layers 40-44 together.

Embodiments such as that shown in the figures allows for using a highly conductive material, such as copper, while reducing or avoiding adverse effects on a glass substrate associated with an electrical component.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

I claim:

1. An electrically conductive connector, comprising:

at least one layer comprising a first material having a first coefficient of thermal expansion, the at least one layer comprising the first material comprises a channel having a depth; and a layer comprising a second material having a second coefficient of thermal expansion, the layer comprising the second material being situated at least partially within the at least one layer comprising the first material, the layer comprising the second material being bonded together with the at least one layer comprising the first material, the layer comprising the second material is situated at least partially within the channel, a first layer of the at least one layer comprising the first material has a first thickness, a second layer of the at least one layer comprising the first material has a second thickness, the layer comprising the second material has a third thickness, and the depth is approximately equal to a sum of the second thickness and the third thickness.

2. The electrically conductive connector of claim 1, wherein the first thickness is greater than the third thickness; and the third thickness is greater than the second thickness.

* * * * *